US005213449A

United States Patent [19]

Morris

[11] Patent Number: 5,213,449

[45] Date of Patent: May 25, 1993

[54] APPARATUS FOR INSERTING WICK DRAINS INTO THE EARTH

[76] Inventor: T. Richard Morris, 301 Warehouse Dr., Matthews, N.C. 28105

[21] Appl. No.: 726,589

[22] Filed: Jul. 8, 1991

[51] Int. Cl.[5] ..... E02D 7/06; E02D 7/20; E02D 3/10

[52] U.S. Cl. ..... 405/232; 405/50; 405/249; 173/149; 173/152; 175/162

[58] Field of Search ..... 175/19, 122, 162, 170; 226/52, 69, 76, 82, 181; 405/50, 228, 232, 245, 246, 249; 173/141, 148, 149, 152; 74/422

[56] References Cited

U.S. PATENT DOCUMENTS

| | | | |
|---|---|---|---|
| 48,515 | 7/1865 | Campbell et al. | 175/162 |
| 1,294,154 | 2/1919 | Payne | 175/122 X |
| 1,464,231 | 8/1923 | Yezek | 175/170 X |
| 2,239,024 | 4/1941 | Vance | 175/162 |
| 3,412,813 | 11/1968 | Johnson | 173/141 |
| 3,513,587 | 5/1970 | Fischer | 74/422 X |
| 3,891,186 | 6/1975 | Thorsell | 254/29 R |
| 4,166,508 | 9/1979 | van den Berg | 175/20 |
| 4,397,199 | 8/1983 | Jahn | 74/422 |
| 4,755,080 | 7/1988 | Cortlever et al. | 405/50 |

FOREIGN PATENT DOCUMENTS

| | | | |
|---|---|---|---|
| 65252 | 2/1950 | Netherlands . | |
| 7707303 | 1/1979 | Netherlands . | |
| 7805153 | 11/1979 | Netherlands . | |
| 1027357 | 7/1983 | U.S.S.R. | 175/162 |

*Primary Examiner*—Dennis L. Taylor
*Assistant Examiner*—John Ricci
*Attorney, Agent, or Firm*—Shefte, Pinckney & Sawyer

[57] ABSTRACT

Apparatus for inserting flexible drainage wick members downwardly into the earth which comprises a mast having a hollow longitudinally extending chamber therein, and an insertion tube disposed in the chamber for movement therein, the insertion tube being provided with a projecting flange that extends outwardly from the chamber through a longitudinal slot therein and that includes openings located at spaced intervals along the longitudinal extent of the flange. A drive gear, operated by a motor, is mounted near the bottom of the mast so that the teeth of the drive gear can positively engage the openings in the insertion tube flange and positively drive the insertion tube into and out of the earth. A pair of spaced support rollers are positioned behind the insertion tube flange at its point of contact with the drive gear to support the flange and also permit any foreign matter ejected from the flange openings by the gear teeth to fall to the earth.

9 Claims, 5 Drawing Sheets

APPARATUS FOR INSERTING WICK DRAINS INTO THE EARTH

BACKGROUND OF THE INVENTION

This invention relates generally to apparatus for inserting drainage wicks into the earth, and more specifically to an improved drive arrangement for positively engaging and driving the wick-carrying tube into the earth.

A well-known technique for preparing soil that has a high moisture content, such as wet clay for example, is to drive into the soil a drainage wick that penetrates deep into the soil, with the top end of the wick maintained above the surface of the soil. The drainage wick is formed of any suitable material which is water permeable so that the water in the soil can permeate the walls of the drainage wick and flow upwardly therein to the surface of the soil as a result of pressures in the soil beneath the surface thereof. The inherent pressures in the soil may be enhanced by putting a layer of sand on top of the wet soil so that the weight of the sand will assist in forcing the water into, and upwardly through, the drainage wick, where it can be readily dispersed.

Since the drainage wick is generally flexible, it must be carried into the ground by utilizing a rigid insertion tubeformed of a suitable metal, and this insertion tube is forcibly driven into the soil, and then pulled out of the soil, by any one of different known drive systems. For example, in Dutch Patent No. 7,707,303, there is disclosed a drive arrangement which uses a vibratory driver that engages the top portion of the insertion tube for driving the bottom end of the insertion tube into the earth. In Cortlever U.S. Pat. No. 4,755,080, a combination of hydraulic cylinders and a cable drive that engages the insertion tube at the upper end thereof is utilized, and a somewhat similar hydraulic motor and chain drive is disclosed in Thorsell U.S. Pat. No. 3,891,186. In Van den Berg U.S. Pat. No. 4,166,508, the disclosed drive arrangement includes flexible steel tubes that are driven into the ground with the drainage wick therein, utilizing rotating drums. It is also known to combine two of the above-described drives in a single installation, such as combining a vibratory driver with a chain or cable drive fixed to the top of the insertion tube. In generally, most of these prior art arrangements engage and drive the insertion tube at the top end thereof, and this arrangement usually requires a heavier boom structure for supporting the insertion tube and the drive arrangement therefor, whereby the overall weight of the system is increased, as well as the cost and maintenance of the system.

It is also known that the insertion tube can be driven into the earth utilizing a pair of friction rollers positioned just above the surface of the earth, these rollers being formed of a material that will frictionally engage the side walls of the insertion tube disposed therebetween with the frictional engagement between the rollers and the insertion tube driving the insertion tube into the ground. While this arrangement overcomes some of the disadvantages of the top drive systems discussed above, it also has several disadvantages. More specifically, since these drainage wick insertion systems usually operate in an environment that includes high moisture content and wet soil, the frictional engagement between the sides of the insertion tube and the friction rollers can be significantly diminished by the presence of moisture and mud between the engaging surfaces of these elements, and the moisture and mud can act as a lubricant that results in an improper and insufficient driving force being applied to the insertion tube. Also, since the wet soil is abrasive in nature, its presence between the engaging surfaces of the friction rollers and the insertion tube can cause excessive wear of the friction rollers. Finally, in these systems, the friction rollers must be placed on opposite sides of the insertion tube and urged thereagainst with a sufficient force to create the necessary frictional purchase to drive the insertion tube into the ground, all of which imposes stress on the insertion tube and may require strengthening thereof through the use of heavier metal since the positioning of the friction rollers generally eliminates the possibility of strengthening the insertion tubes using less expensive strengthening ribs.

In accordance with the present invention, apparatus for inserting drainage wicks is provided which overcomes or alleviates the above-described drawbacks of known apparatus.

SUMMARY OF THE INVENTION

The apparatus of the present invention comprises a mast that is adapted to be arranged with a generally vertical extent above the earth, and it is formed with a longitudinally extending chamber therein and a continuous slot in one wall of such chamber. An earth penetrating tube is carried in the longitudinal chamber of the mast for vertical movement therein, such tube being hollow for receiving a flexible drainage wick for movement therewith. In the preferred embodiment of the present invention, the tube is also formed with a longitudinally extending flange member that projects outwardly through the slot in the mast chamber, and this flange includes openings at spaced intervals along its longitudinal extent. A drive arrangement is provided adjacent the lower end of the mast, and the drive arrangement includes a drive gear that has teeth positioned to positively engage the spaced openings in the projecting flange, and a motor is provided for rotating the drive gear to cause the tube and the drainage wick therein to be driven longitudinally through the chamber of the mast and into the earth by virtue of the positive engagement between the drive gear and the flange on the insertion tube.

In the preferred embodiment of the present invention, the drive arrangement includes at least two support rollers that are positioned to engage the insertion tube flange on the side thereof that is opposite to the drive gear so as to provide support for the flange near its point of contact with the drive gear, and the pair of support rollers are spaced from one another and disposed, respectively, on opposite sides of such point of contact so that any foreign matter pushed from the openings in the flange by the teeth of the drive gear can fall to the earth through the spacing between the support rollers. Also, the teeth of the drive gear have a shape and a radial extent that causes the teeth to pass all the way through the openings in the flange and to occupy substantially all of the opening during engagement therewith, so that any foreign matter in the openings will be completely discharged therefrom by the gear teeth.

DESCRIPTION OF THE PREFERRED EMBODIMENT

Figure 1:
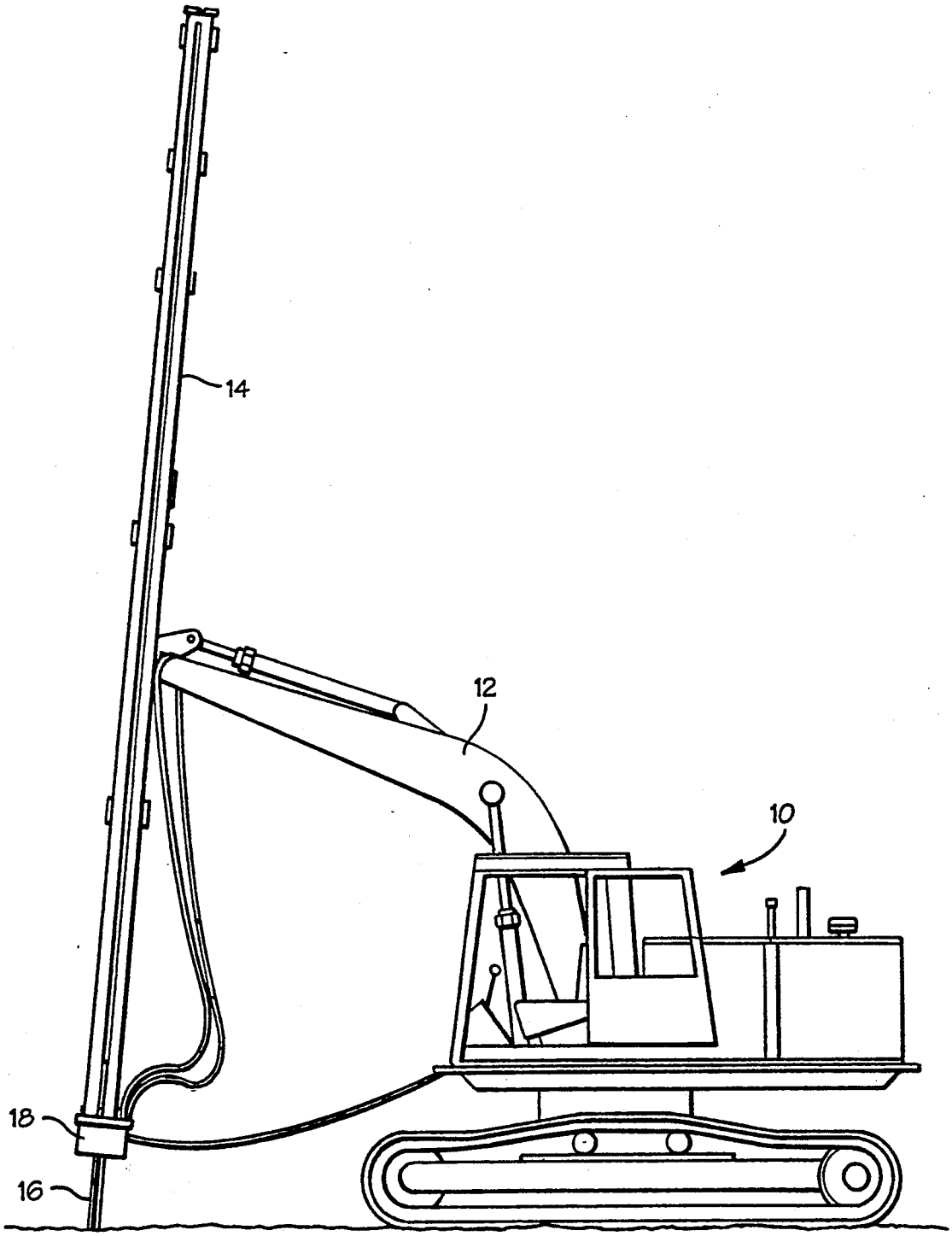
FIG. 1 is a general view illustrating the apparatus of the present invention mounted on a vehicle.

Looking now in greater detail at the accompanying drawings, FIG. 1 illustrates a vehicle 10, which may be of any suitable type used in supporting and manipulating drainage wick inserting apparatus, having arms 12 to which is attached a generally vertically-extending mast 14 from which a drainage wick insertion tube 16 is driven into the earth by a drive system 18. In FIG. 1, the insertion tube 16 is shown as being inserted into the earth at a slight angle to vertical, but it is to be understood that the arm 12 of the vehicle 10 can be manipulated to drive the insertion tube 16 into the ground in a vertical direction, or in other offset angles different from that shown in FIG. 1 but still generally vertical.

Figure 3:
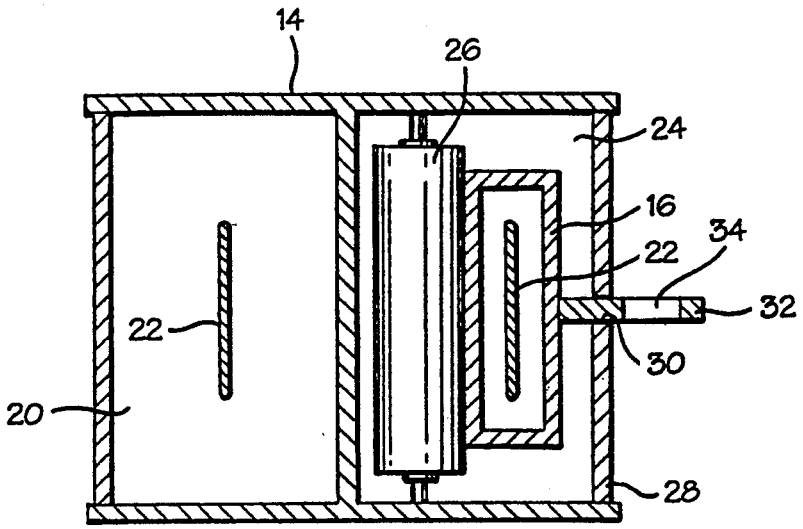
FIG. 3 is a sectional view taken along a horizontal plane in the mast of the apparatus of the present invention.

As best seen in FIG. 3, the mast 14 is of conventional construction, and it includes a first longitudinally extending chamber 20 through which a conventional drainage wick 22 passes upwardly therethrough after being fed into the first chamber 20 from any suitable source, such as a supply roll (not shown) on which a predetermined length of the drainage wick 22 is wound. In a known and conventional manner, the drainage wick 22 extends upwardly through the first chamber 20 to the top thereof where it passes over a roller or other suitable guide (not shown) and then downwardly through the insertion tube 16 which is carried in a second longitudinally extending chamber 24 in the mast 14, the second chamber 24 being provided with a plurality of rollers 26 or other known arrangements which rotatably or slidably support the insertion tube for movement through the second chamber 24 in a manner to be described presently. One of the longitudinally extending walls 28 of the second chamber 26 is preferably in the form of a replaceable wear plate, and a continuous slot 30 is formed in the wall 28 to extend along the entire longitudinal extent thereof.

Figure 4:
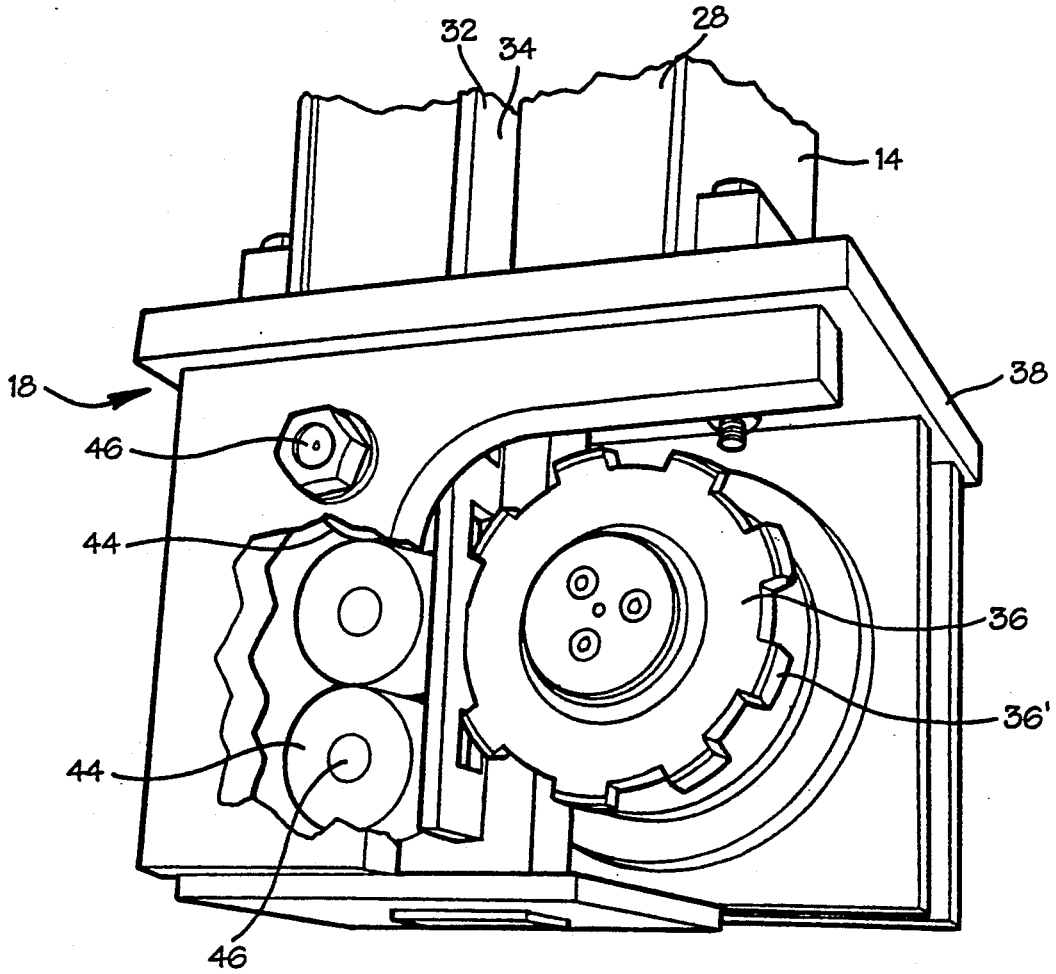
FIG. 4 is a perspective view further illustrating the engagement of the drive gear with the insertion tube flange.

The insertion tube 16 is generally rectangular in shape as illustrated in FIG. 3, and the drainage wick 22 extends downwardly through the entire length thereof with the end of the drainage wick 22 being anchored in any conventional manner at the bottom end of the insertion tube 16, such as by having a small length of the drainage wick 22 extend beyond the bottom end of the insertion tube 16 and then folded upwardly alongside the side wall of the insertion tube 16, so that when the insertion tube 16 is driven into the earth it will carry the drainage wick 22 with it. As best seen in FIGS. 3 and 4, the insertion tube 16 is formed with a flange 32 that projects perpendicularly from a side wall of the insertion tube 16 so as to project outwardly through the longitudinally extending slot 30 in the chamber wall 28, and the flange 32 is formed with openings 34 located at spaced intervals along its entire longitudinal extent.

Figure 2:
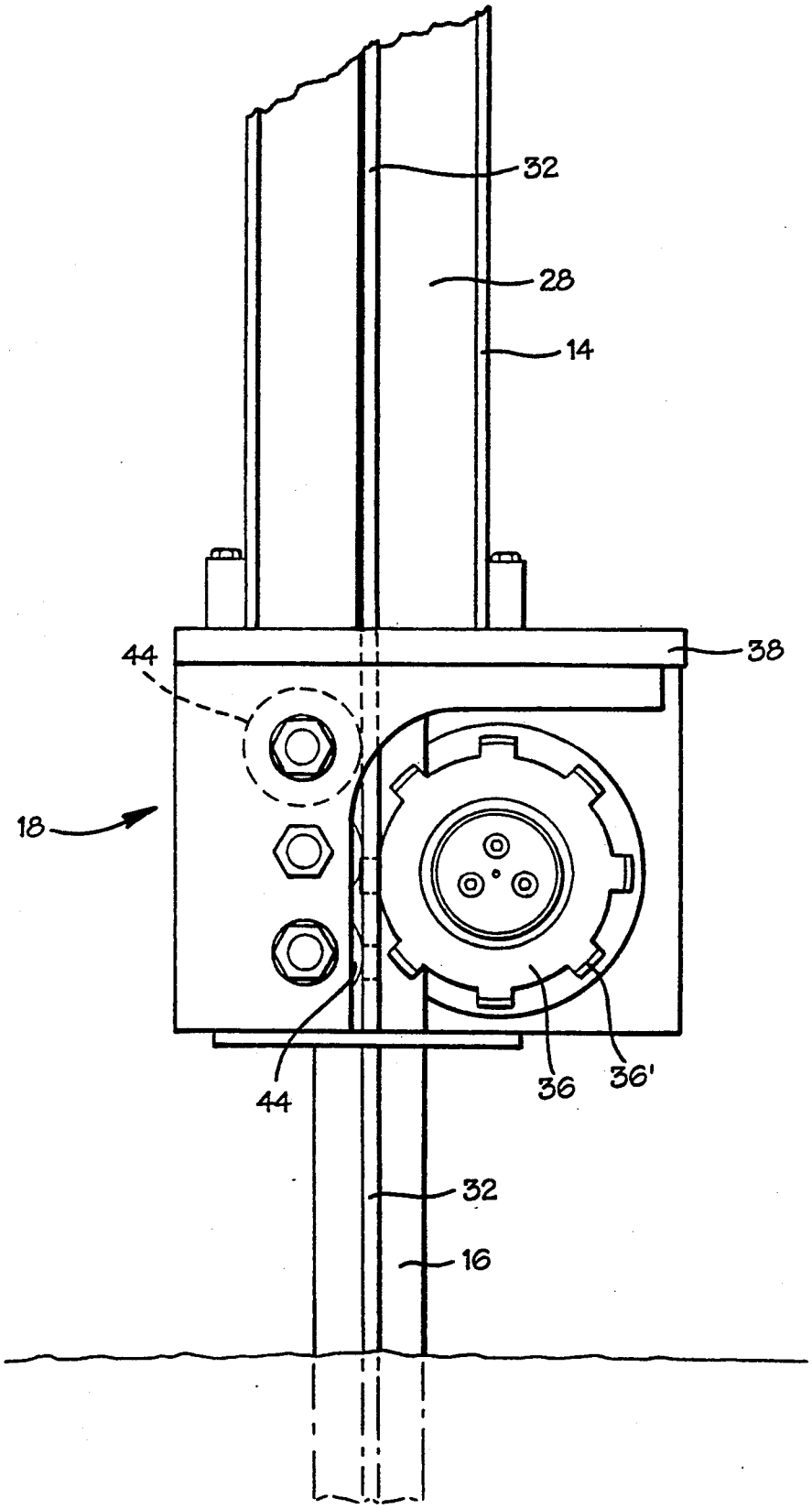
FIG. 2 is a detailed view illustrating the engagement of the drive gear and the flange on the insertion tube.
Figure 5:
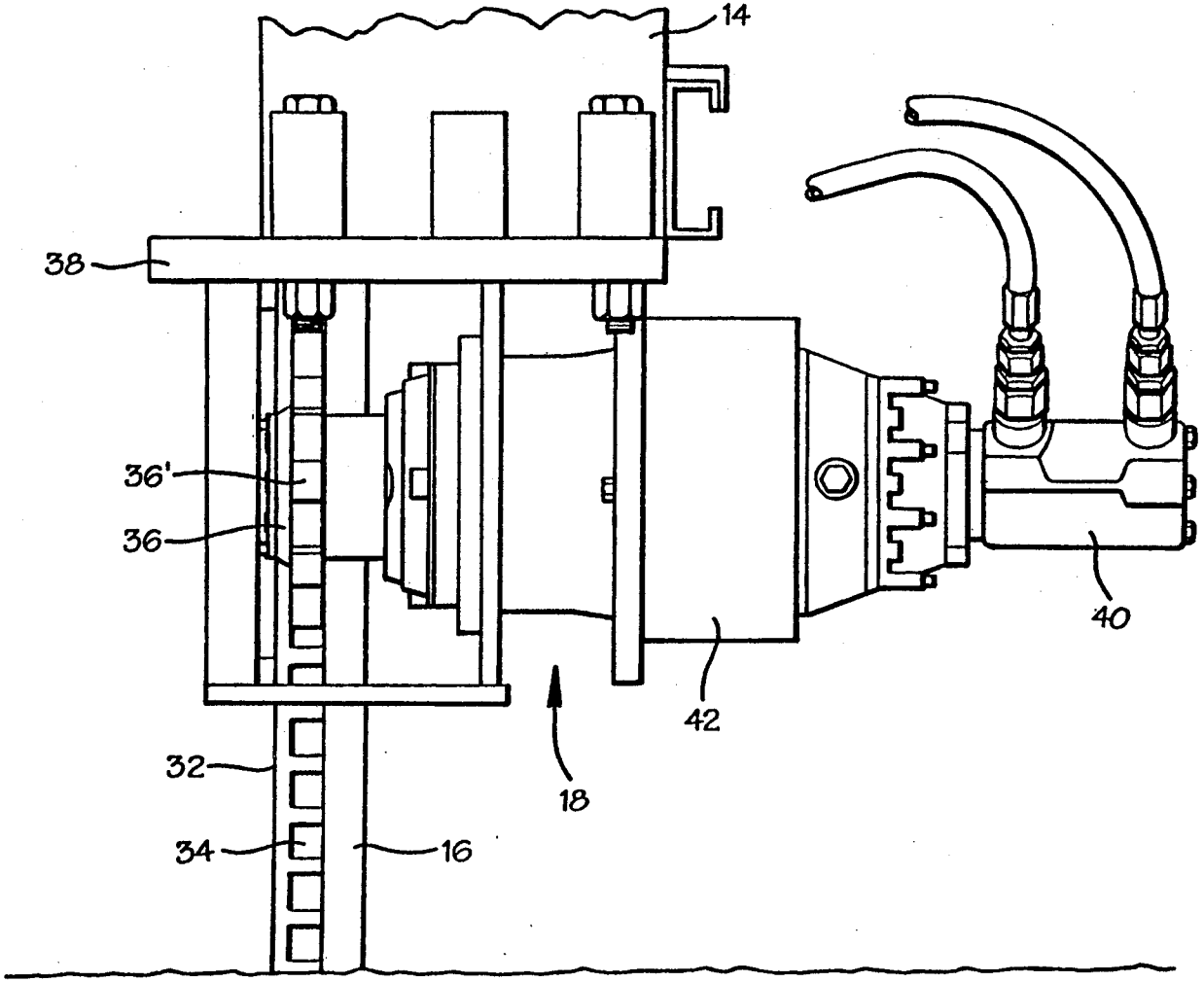
FIG. 5 is a detailed view illustrating the drive motor for the drive gear for the present invention.

The drive system 18 is fixed to the mast 14 at the bottom end thereof, which is generally spaced a few feet above the earth as illustrated in FIG. 1, and this drive system 18, as illustrated in FIG. 5, includes a drive gear 36 mounted for rotation in a housing 38 which also supports a drive motor 40 and a gear reduction unit 42 through which the drive gear 36 is driven. In the preferred embodiment of the present invention, the drive motor 40 is a conventional hydraulic motor having an inlet tube and an outlet tube through which pressurized hydraulic fluid from any convenient source can be utilized to operate the drive motor 40, and the gear reduction unit 42 has a gear reduction ratio of 45:1. However, it is to be understood that any suitable drive arrangement can be used to rotate the drive gear 36. As best seen in FIGS. 2 and 4, the drive gear 36 is positioned so that the teeth 36' thereof will engage the openings 34 in the flange 32, whereby rotation of the drive gear 36 will positively engage the insertion tube flange 32 and provide a positive drive for forcing the insertion tube 16 downwardly into the earth. A pair of support rollers 44 are rotatably carried in the housing 38, and they are located to directly engage the side of the insertion tube flange 32 opposite to its engagement by the drive gear 36, the support rollers 44 being rotatable about their own shafts 46 to provide support for the flange 32 adjacent its point of contact with the drive gear 36 where the force imposed on the flange 32 by the drive gear 36 is at a maximum. Also, as best seen in FIGS. 2 and 4, the support rollers 44 are mounted so that the points of contact between them and the flange 32 are spaced apart, and they are located on each side of the point of contact at which the teeth 36' extend through the flange openings 34. By virtue of this arrangement, any dirt, mud or other foreign matter which was disposed in the flange openings 34 is forced out of the openings as the gear teeth 36' become inserted therein during driving engagement by the drive gear 36, and this dirt, mud or foreign matter can easily fall to the earth through the spacing between the support rollers 44 rather than becoming lodged between the support rollers 44 and the flange 32 and create abrasion and wear thereat. In this same regard, the gear teeth 36, are designed with a shape and a radial extent that causes them to pass all the way through the flange openings 34 and to occupy substantially the entire area of such openings during engagement therewith, whereby virtually all of the foreign matter in the flange openings 34 will be completely discharged therefrom by the gear teeth 36'.

In operation, the insertion tube 16 is located with substantially its entire vertical extent disposed within the second longitudinal channel 24 of the mast 14, with the flange 32 projecting outwardly through the longitudinal slot 30, and with the openings 34 in the lower end thereof being engaged by the drive gear 36. The drainage wick 22 is fed upwardly through the first longitudinal mast chamber 20, across the top thereof, and downwardly through the hollow interior of the insertion tube 16 so that the bottom end of the drainage wick 22 can be anchored at the bottom end of the insertion tube in any suitable manner, all in a manner well known to those skilled in the art. The drive motor 40 is supplied with hydraulic fluid, which may come from the hydraulic system of the vehicle 10 or any other suitable source, to rotate the drive gear 36 through the reduction gear unit 42, whereupon the insertion tube 16, with the drainage wick 22 carried therein, is forced downwardly into the earth by the positive engagement of the drive gear 36 with the openings 34 in the flange 32. After the insertion tube 16 has been driven into the earth to a desired depth, the rotation of the drive motor 40 is reversed so that the aforesaid positive engagement between the drive gear 36 and the flange 32 will raise the insertion tube 16 upwardly and back to the surface of the earth, leaving the drainage wick 22 in place in the earth with only the top end thereof projecting upwardly from the earth.

As described above, the positive engagement between the drive gear 36 and the openings 34 in the flange 32 provides a relatively simple, inexpensive, and highly effective arrangement for forcing the insertion tube 16 into and out of the earth under virtually all operating conditions, and this arrangement does not suffer from most of the above-described drawbacks associated with known apparatus of this type.

Figure 6:
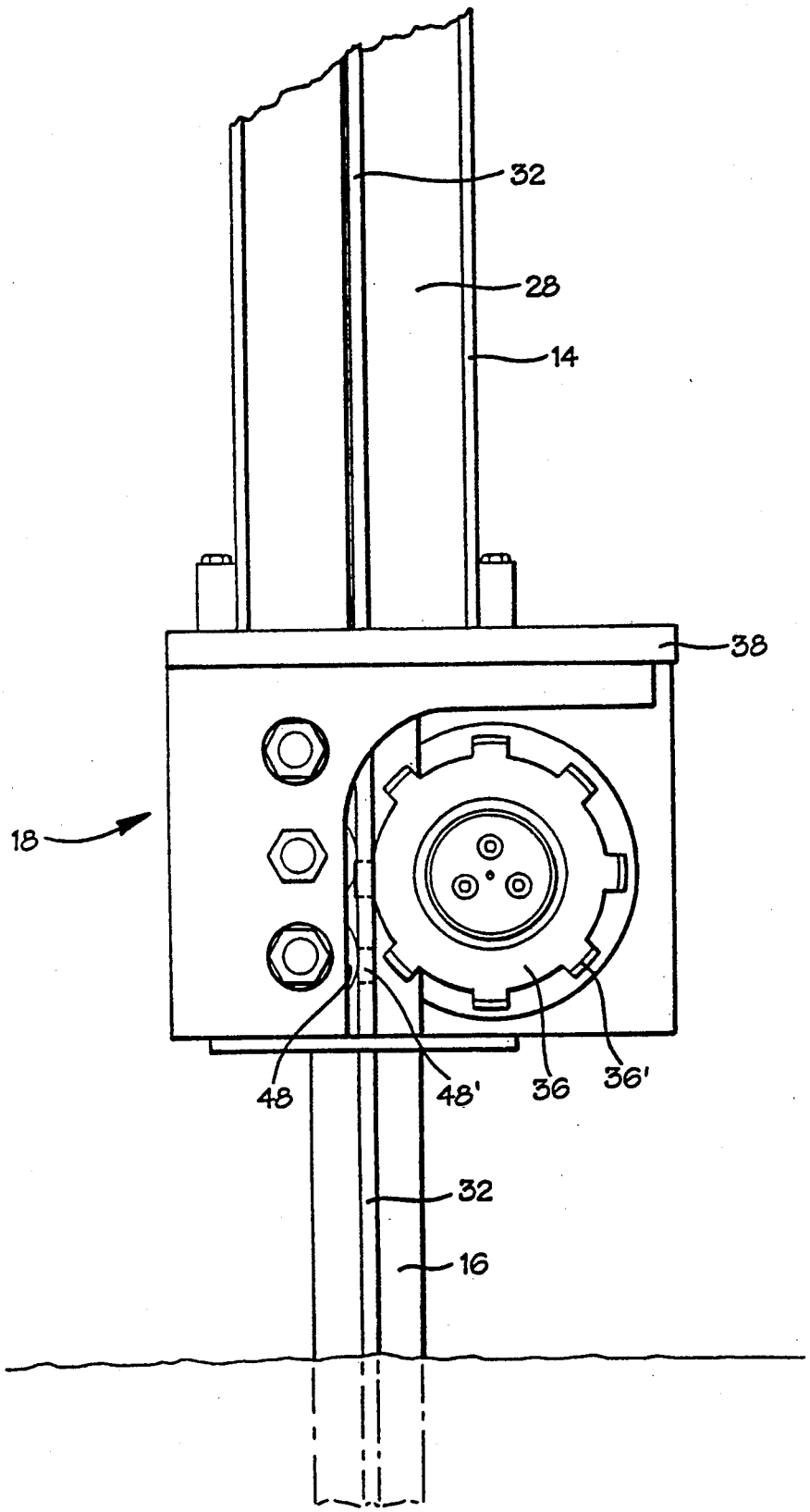
FIG. 6 is a detailed view similar to FIG. 2 illustrating an alternate embodiment of the present invention.

An alternate embodiment of the present invention is illustrated in FIG. 6. In this embodiment, the lower roller in the embodiment illustrated in FIGS. 1-5 is replaced with a gear 48 having teeth 48' that engage the openings 34 in the flange 32. This gear 48 may be an idler gear mounted for free rotation about its shaft, in which case the teeth 48, will enter the openings 34 before the teeth 36' of the drive gear 36 as the tube 16 is being raised from the ground after insertion of a drainage wick 22, and thereby remove any mud or other foreign matter from the openings 34 before they encounter the greater frictional load that is imposed in them by the forces of the drive gear teeth 36'. If desired, the gear 48 can also be a drive gear itself like drive gear 36 and rotated by its own motor (not shown) like the drive motor 40 for the drive gear 36, in which case the gear 48 can be used to distribute the driving load more evenly as compared to utilizing just a single drive gear. In either event, the gear 48, whether an idler gear or a drive gear, also serves to add support for the flange 32 in a manner similar to the rollers 44.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for inserting flexible drain members downwardly into the earth, said apparatus comprising:

a) mast means adapted to be arranged with a generally vertical extent above the earth, said mast means being formed with a longitudinally extending chamber therein and a continuous longitudinal slot formed in one wall of said chamber;

b) an earth penetrating tube carried for vertical movement in said longitudinal chamber of said mast means, said tube being hollow for receiving a drain member for movement therewith, said tube being formed with a longitudinally extending flange member that projects outwardly through said slot in said mast and that includes openings at spaced intervals along its longitudinal extent, said flange member extending longitudinally along said tube for a substantial length that is at least equal to the depth to which said tube will penetrate the earth; and c) drive means for driving said tube into and o of the earth, said drive means including a drive gear that has teeth positioned to engage said spaced openings in said projecting flange, and moor means for rotating said drive gear to cause said tue and said drain member therein to be driven longitudinally through said chamber of said mast means and into and out of the earth, said drive means being positioned adjacent the lower end of said mast at a position selected in correspondence with the longitudinal extent of said projecting flange such that lower ones of said spaced openings in said protecting flange are engageable by said drive gear to initially drive said tube into the earth and upper ones of said spaced openings are engageable by said drive gear to continue driving said tube into the earth after said projecting flange has also penetrated the earth.

2. Apparatus for inserting flexible drain members as defined in claim 1, wherein said drive means includes at least one support roller positioned to engage said flange on the side thereof opposite to said drive gear to provide support for said flange adjacent its point of contact with said drive gear.

3. Apparatus for inserting flexible drain members as defined in claim 1, wherein said drive means includes a pair of support rollers positioned to engage said flange on the side thereof opposite to said drive gear, to provide support for said flange adjacent its point of contact with said drive gear, said pair of support rollers being spaced from one another and disposed, respectively, on opposite sides of said point of contact between said flange and said drive gear so that any foreign matter pushed from said openings in said flanges by said drive gear teeth can 10 fall to the earth through said spacing between said pair of support rollers.

4. Apparatus for inserting flexible drain members as defined in claim 3, wherein said teeth of said drive gear have a shape and a radial extent that causes such teeth to pass all the way through said openings in said flange and to occupy substantially all of said openings during engagement therewith, whereby any foreign matter in said openings will be discharged therefrom by said gear teeth.

5. Apparatus for inserting flexible drain members as defined in claim 1, wherein said drive means includes a second gear that has teeth positioned to engage said spaced openings in said projecting flange, said second gear being an idler gear located beneath said drive gear and on the opposite side of said flange with respect to said drive gear to remove foreign matter from said spaced openings in advance of said drive gear when said tube is being moved out of the earth.

6. Apparatus for inserting flexible drive members as defined in claim 1, wherein said drive means includes a second gear that has teeth positioned to engage said spaced openings in said projecting flange to distribute the driving load imposed on said flange.

7. Apparatus for inserting flexible drain members downwardly into the earth, said apparatus comprising:

a) mast means adapted to be arranged with a generally vertical extent above the earth, said mast means being formed with a longitudinally extending chamber therein;

b an earth penetrating tube carried for vertical movement in said longitudinal chamber of said mast means, said tube being hollow for receiving a drain member for movement therewith, said tube being formed with a longitudinally extending member that includes openings at spaced intervals along its longitudinal extent, said flange member extending longitudinally along said tube for a substantial length that is at least equal to the depth to which said tube will penetrate the earth; and c) drive means for driving said tube into and out of the earth, said drive means including a drive gear that has teeth positioned to engage said spaced openings in said tube, and motor means for rotating said drive gear to cause said tube and said drain member therein to be driven longitudinally through said chamber of said mast means and into and out of the earth, said drive means being positioned adjacent the lower end of said mast at a position selected in correspondence with the longitudinal extent of said projecting flange such that lower ones of said spaced openings in said protecting flange are engageable by said drive gear to initially drive said tube into the earth and upper ones of said spaced openings are engageable by said drive gear to continue driving said tube into the earth after said projecting flange has also penetrated the earth.

8. Apparatus for inserting flexible drain members as defined in claim 7, wherein said drive means includes a second gear that has teeth positioned to engage said spaced openings in said longitudinally extending member, said second gear being an idler gear located beneath said drive gear and on the opposite side of said member with respect to said drive gear to remove foreign matter from said spaced openings in advance of said drive gear when said tube is being moved out of the earth.

9. Apparatus for inserting flexible drain members as defined in claim 7, wherein said drive means includes a second gear that has teeth positioned to engage said spaced openings in said longitudinally extending member to distribute the driving load imposed on said member.

* * * * *

UNITED STATES PATENT AND TRADEMARK OFFICE

CERTIFICATE OF CORRECTION

PATENT NO. : 5,213,449

DATED : May 25, 1993

INVENTOR(S) : T. Richard Morris

It is certified that error appears in the above-identified patent and that said Letters Patent is hereby corrected as shown below:

Column 1, line 27, delete "tubeformed" and insert therefor -- tube formed --.

Column 1, line 46, delete "generally" and insert therefor -- general --.

Column 4, line 43, delete "36," and insert therefor -- 36' --.

Column 5, line 23, delete "48," and insert therefor -- 48' --.

Column 6, line 11, delete "o" and insert therefor -- out --.

Column 6, line 14, delete "moor" and insert therefor -- motor --.

Column 6, line 15, delete "tue" and insert therefor -- tube --.

Column 6, lines 22-23, delete "protecting" and insert therefor -- projecting --.

Column 6, line 45, delete "10".

Column 6, line 64, delete "drive" and insert therefor -- drain --.

UNITED STATES PATENT AND TRADEMARK OFFICE

CERTIFICATE OF CORRECTION

PATENT NO. :5,213,449
DATED :May 25, 1993
INVENTOR(S) :T. Richard Morris

It is certified that error appears in the above-indentified patent and that said Letters Patent is hereby corrected as shown below:

Column 8, lines 3-4, delete "protecting" and insert therefor--projecting--.

Signed and Sealed this

Fifth Day of April, 1994

Bruce Lehman

*Attest:*

BRUCE LEHMAN

*Attesting Officer*

*Commissioner of Patents and Trademarks*

US005213449C1

(12) REEXAMINATION CERTIFICATE (4390th)

United States Patent

Morris

(10) Number: US 5,213,449 C1

(45) Certificate Issued: Jul. 3, 2001

(54) APPARATUS FOR INSERTING WICK DRAINS INTO THE EARTH

(75) Inventor: T. Richard Morris, 301 Warehouse Dr., Matthews, NC (US) 28105

(73) Assignee: T. Richard Morris, Matthews, CA (US)

Reexamination Request:
No. 90/005,724, May 12, 2000

Reexamination Certificate for:

| | |
|---|---|
| Patent No.: | **5,213,449** |
| Issued: | **May 25, 1993** |
| Appl. No.: | **07/726,589** |
| Filed: | **Jul. 8, 1991** |

Certificate of Correction issued Apr. 5, 1994.

(51) Int. Cl.[7] ..... E02D 7/06; E02D 7/20; E02D 3/10

(52) U.S. Cl. ..... 405/232; 405/50; 405/249; 173/149; 173/152; 175/162

(58) Field of Search ..... 405/50, 228, 232, 405/245, 246, 249; 173/141, 148, 149, 152; 74/422; 175/19, 122, 162, 170; 226/52, 69, 76, 82, 181

(56) References Cited

U.S. PATENT DOCUMENTS

| | | | | |
|---|---|---|---|---|
| 2,239,024 | * | 4/1941 | Vance | 175/162 |
| 2,577,252 | | 12/1951 | Kjellman . | |
| 3,891,186 | * | 6/1975 | Thorsell | 254/29 R |
| 4,142,596 | | 3/1979 | Dressel et al. | 175/113 |
| 4,166,508 | * | 9/1979 | Van Den Berg | 175/20 |
| 4,172,391 | | 10/1979 | Dressel | 74/250 |
| 4,254,638 | | 3/1981 | Dressel | 64/2 |
| 4,431,063 | | 2/1984 | Dressel et al. | 173/149 |

FOREIGN PATENT DOCUMENTS

| | | | |
|---|---|---|---|
| 2003769 | | 3/1979 | (GB) . |
| 7707303 | * | 7/1977 | (NL) . |
| 1027357 | * | 7/1983 | (SU) . |

OTHER PUBLICATIONS

Munn, Walter D., "Unexpected Soil Problems Fails to Slow Building Project," Chaners Publishing Company, Oct., 1988, p. 1.

Long, Richard P., "Wick Drains–An Overview," Transportation Research Circular, Sep. 1986, pp. 2–6.

Warren, M. James, "Impacts of Design and Specification Requirements on Actual Wick Drain Construction," Transportation Research Circular, Sep. 1986, pp. 10–13.

* cited by examiner

*Primary Examiner*—F. Lagman

(57) ABSTRACT

Apparatus for inserting flexible drainage wick members downwardly into the earth which comprises a mast having a hollow longitudinally extending chamber therein, and an insertion tube disposed in the chamber for movement therein, the insertion tube being provided with a projecting flange that extends outwardly from the chamber through a longitudinal slot therein and that includes openings located at spaced intervals along the longitudinal extent of the flange. A drive gear, operated by a motor, is mounted near the bottom of the mast so that the teeth of the drive gear can positively engage the openings in the insertion tube flange and positively drive the insertion tube into and out of the earth. A pair of spaced support rollers are positioned behind the insertion tube flange at its point of contact with the drive gear to support the flange and also permit any foreign matter ejected from the flange openings by the gear teeth to fall to the earth.

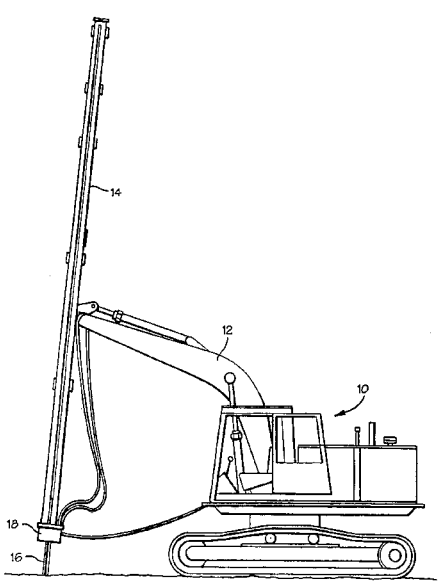

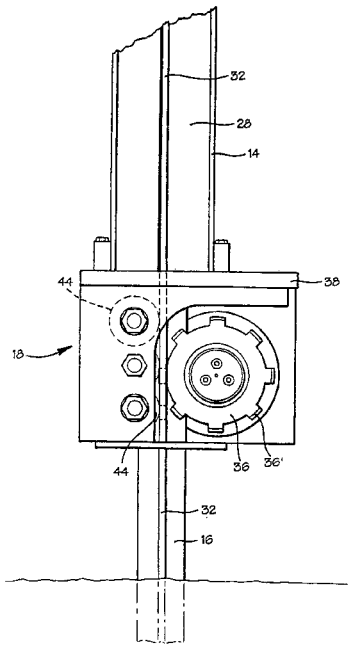

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 is confirmed.

* * * * *